US007487628B2

(12) United States Patent
Foster

(10) Patent No.: US 7,487,628 B2
(45) Date of Patent: Feb. 10, 2009

(54) SADDLE CUSHIONING ASSEMBLY

(75) Inventor: Holly Ann Foster, 326 Twykingham Pl., Manhattan, KS (US) 66503

(73) Assignees: Holly Ann Foster, Manhattan, KS (US); Richard L. Foster, Manhattan, KS (US)

( * ) Notice: Subject to any disclaimer, the term of this patent is extended or adjusted under 35 U.S.C. 154(b) by 398 days.

(21) Appl. No.: 11/304,352

(22) Filed: Dec. 15, 2005

(65) Prior Publication Data

US 2007/0137148 A1 Jun. 21, 2007

(51) Int. Cl.
*B68C 1/12* (2006.01)

(52) U.S. Cl. ..... 54/66; 54/44.1

(58) Field of Classification Search ..... 54/44.1, 54/65, 66

See application file for complete search history.

(56) References Cited

U.S. PATENT DOCUMENTS

| | | | | |
|---|---|---|---|---|
| 97,295 | A | 11/1869 | Hogg | |
| 227,610 | A | 5/1880 | Butler | |
| 530,864 | A | 12/1894 | Torrey | |
| 809,276 | A | 1/1906 | Aulton | |
| 5,027,589 | A | 7/1991 | Gleb et al. | |
| 5,175,986 | A | 1/1993 | Farley | |
| 5,299,412 | A * | 4/1994 | Cudney et al. | 54/66 |
| D350,420 | S | 9/1994 | Cudney et al. | |
| 5,613,247 | A * | 3/1997 | Bowman | 2/81 |
| 6,138,611 | A | 10/2000 | Thielemann | |
| 6,272,817 | B1 | 8/2001 | Further | |
| 6,484,480 | B2 * | 11/2002 | Rauch | 54/66 |
| 6,658,827 | B2 * | 12/2003 | Brownlie | 54/66 |
| 6,725,363 | B1 | 4/2004 | Bates | |
| 2002/0189211 | A1 | 12/2002 | DeCosemo | |
| 2005/0086914 | A1 | 4/2005 | Fennelly | |

OTHER PUBLICATIONS

International Patent Application No. WO90/00518 published Jan. 25, 1990, Inventor: Larkins.

German Patent Application Publication No. 0399915 published Nov. 28, 1990; Inventor: Letixerand.

* cited by examiner

*Primary Examiner*—Rob Swiatek
(74) *Attorney, Agent, or Firm*—Kenneth H. Jack; Davis & Jack, L.L.C.

(57) ABSTRACT

A saddle cushioning assembly having component structures including a flexible pad having an upper surface and having a longitudinal midline; a flexible "T" hook having left and right arms; and hook attaching stitching fixedly interconnecting the flexible pad and the flexible "T" hook, the hook attaching stitching positioning the flexible "T" hook so that the flexible "T" hook's left and right arms overlie the flexible pad's upper surface and respectively extend leftwardly and rightwardly from the flexible pad's longitudinal midline.

16 Claims, 4 Drawing Sheets

SADDLE CUSHIONING ASSEMBLY

FIELD OF THE INVENTION

This invention relates to horseback riding saddles. More particularly, this invention relates to specialized pads adapted for cushioning pressurized contract between a horse's back and a horseback riding saddle.

BACKGROUND OF THE INVENTION

Under ideal circumstances, a horseback riding saddle is fitted to a particular horse, allowing the saddle's horseback contacting skirt panels to evenly rest upon the horse's back. A properly fitted saddle applies evenly dispersed pressure laterally against the upper left and right aspects of the horse's barrel, and applies evenly dispersed pressure longitudinally between the horse's withers and loins. Such fitted saddles commonly include a layer of wool loft or fleece material applied directly to the contact surfaces of the skirt panels. Additionally, a saddle pad is commonly interposed between the saddle and a horse's back, such pad typically serving dual functions of providing additional cushioning of the horse's back, and preventing sweat from soaking through to the saddle.

Where a horseback riding saddle, such as described above, is well fitted to a horse, maintenance of a precise alignment of such saddle pad with respect to the horse and the saddle is typically of little consequence. However, saddles are often used for time periods making up a major portion of the life span of a horse. As a horse ages, gradual diminishment of the tone and bulk of musculature across the horse's back tends to change the shape of the horse's back, and may result in "swaying" of the back. Such changes over time often undesirably confound or disrupt the fit of that horse's saddle. Continued use of a poorly fitted saddle often tends to "sore" the horse's back by causing pressure points at the horse's withers and loins, or by causing free space "clapping" between the horse's back and undersurfaces of the saddle.

In the equestrian arts, specialized saddle pads incorporating shim receiving pockets are known. Such shim receiving pockets typically receive and hold saddle fitting shims which commonly comprise tailored and fitted felt pads having thicknesses varying between ⅛ and ¾ inch. Such saddle fitting shims are known to be strategically placed within such saddle pad pockets in order to assure evenly dispersed saddle/horse pressurized contact despite a saddle's otherwise poor fit. Accordingly, such shims and saddle pad pocket combinations advantageously accommodate for a saddle's poor fit and extend the usefulness of a saddle.

Where a saddle pad includes shims and shim pockets, maintenance of proper alignment of such saddle pad between the saddle and horse is desired. In the event of saddle pad slippage, shims within the pockets of such saddle pad may undesirably produce pressure sores instead of performing their beneficial function of assuring proper saddle fit.

The instant inventive saddle pad solves or ameliorates problems discussed above by fixedly attaching a flexible "T" hook or tab and by securely engaging such "T" hook with under-saddle structures which make up and comprise the saddle's midline gullet space.

BRIEF SUMMARY OF THE INVENTION

A major structural component of the instant inventive saddle cushioning assembly comprises a flexible pad. The flexible pad preferably has a bi-laterally symmetrical shape including left and right sides. Such pad preferably has a longitudinally extending midline or gullet line bisecting the pad and dividing the left and right sides.

The mirror image left and right sides of the flexible pad element are preferably fitted so that they may co-extensively underlie the left and right saddle skirt panels of a saddle to be cushioned. The flexible pad is preferably slightly additionally sized so that, upon its disposition between the saddle and a horse, and upon proper alignment of the flexible pad with respect to the saddle, the edges of the flexible pad may form a border extending peripherally about the outer edges of the saddle's skirt. Such sizing of the pad advantageously facilitates visual confirmation of proper alignment of the pad.

The flexible pad preferably comprises lamb skin having approximately ½ inch to ¾ inch of lamb's wool loft. Suitably, sheep skin with sheep wool loft may be suitably substituted. Also suitably, various commonly known synthetic fabrics and sheet materials including a synthetic cushioning loft may be suitably substituted.

The flexible pad element preferably further forms and comprises left and right saddle shim receiving pockets, such pockets comprising left and right sheets of flexible material fixedly sewn to the flexible pad and positioned so that they respectively overlie and extend longitudinally along the left and right sides of the flexible pad. Such left and right pockets preferably receive custom fitted saddle fitting shims. Such shims preferably comprise felt pads. Upon proper positioning within the pockets, such shims advantageously function to fill gaps between the saddle and the horse's back for restoration of a proper saddle fit.

A further structural component of the instant inventive saddle cushioning assembly comprises a flexible "T" hook or tab having cantilevered left and right arms. Preferably, the flexible "T" hook comprises a semi-ridged sheet of durable plastic, such sheet preferably having a thickness between 1/16 inch and 3/16 inch. The preferred semi-ridged plastic sheet preferably has a lateral width between 3½ inches and 4½ inches, such width allowing the "T" hook to span laterally across the midline gullet of a common saddle. For reasons further discussed below, it is preferred that the upper and lower surfaces of the preferred semi-ridged plastic sheet be rough or asperous for high friction, and it is preferred that such sheet be perforate for heat and water vapor passage. A preferred plastic sheet material satisfying the criteria set forth above comprises square grid plastic canvas which is commonly known and utilized in the needle craft arts.

A further structural component of the instant inventive saddle cushioning assembly comprises hook attaching means which preferably fixedly interconnect the flexible pad and the flexible "T" hook. Where the flexible "T" hook comprises a preferred 4 inch by 6 inch sheet of square grid plastic canvas, such sheet may be placed upon the upper surface of the flexible pad, and may be oriented so that the sheet's longitudinal midline overlies the flexible pad's longitudinal midline. Thereafter, heavy gauge sewing needle drawn nylon stitching may be extended through the square grid apertures of the plastic canvas and through the underlying flexible pad, such stitching firmly and securely sewing such plastic canvas sheet to the flexible pad. In such configuration, the square grid plastic canvas advantageously presents the cantilevered left and right arms which respectively extend leftwardly and rightwardly from the flexible pad's longitudinal midline. In order to more securely stitch the preferred square grid plastic canvas sheet to the flexible pad, an underlying length of nylon strapping, approximate 6", is preferably provided. Engagement of the stitching with such strapping advantageously allows the stitching tension to securely "sandwich" the flexible pad between the overlying sheet of square grid plastic canvas and the underlying length of nylon strapping. Other "T" hook attaching means such as rivets, metal staples, and adhesives may be suitably substituted for the preferred stitching and backing strap attaching means combination.

In use of the instant inventive saddle cushioning assembly, a horseback riding saddle may initially be overturned upon a working surface such as a horse stable bench so that the saddle's skirt panel and midline gullet undersurface structures are upwardly exposed. Thereafter, the flexible pad and "T" hook combination may be folded and oriented to present a "T" configuration. Thereafter, the distal end of the right arm of such "T" hook may be rightwardly and upwardly extended into the saddle's midline gullet space and may immediately be further slidably extended between the upper inner edge of the saddle's right skirt panel and the lower surface of the saddle's seat. Thereafter, the distal end of the "T" hook's left arm may be similarly flexibly manipulated and slidably extended between the upper inner surface of the saddle's left skirt panel and the lower surface of the saddle's seat. Thereafter, the left and right sides of the flexible pad may be respectively leftwardly and rightwardly splayed so that they respectively underlie the left and right panels of the saddle's skirt. Thereafter, such assembled saddle and pad combination may be thrown over a horse's back and cinched down. While the horse is being so saddled, the left and right arms of the flexible "T" hook advantageously bias against and engage the upper inner edges of the saddle skirt's left and right panels, advantageously maintaining a proper lateral and longitudinal alignment of the flexible pad with respect to the saddle.

Upon mounting of a rider upon such saddled horse, as described above, the weight of the rider typically tends to simultaneously downwardly drive the saddle's seat and upwardly drive the left and right upper inner edges of the saddle's skirt panels with respect to each other. Such rider weight induced respective downward and upward driving forces advantageously cause the seat and the left saddle skirt panel, along with the seat, and the right saddle skirt panel to effectively function as left and right clamps, such clamps receiving (as described above) and securely clamping and holding the left and right arms of the "T" hook. Such rider weight clamping effect securely holds the flexible "T" hook in a locked position within the saddle's midline gullet space. Such secure clamping advantageously holds flexible pad in proper alignment with the saddle seat portion between the left and right sides 45 and 47. Where the saddle traditionally includes an open gullet such as is described above, the seat or seat cover 28 is properly characterized as a seat.

Where the flexible pad includes preferred shim receiving pockets and saddle shims, as described above, the rider weight induced clamping effect imposed upon the "T" hook's left and right arms advantageously securely and fixedly positions such shims in their proper orientations with respect to the saddle and the horse.

Where the "T" hook comprises the preferred sheet of square grid plastic canvas, such canvas's matrix of apertures advantageously facilitates air and vapor flow and heat passage within the saddle's midline gullet space while the asperous or roughened nature of such sheet frictionally resists undesirable slippage of the sheet within the gullet space.

Accordingly, objects of the instant invention include the provision of a saddle cushioning assembly comprising a flexible pad and an attached saddle gullet structure engaging flexible "T" hook.

A further object comprises the provision of and utilization of saddle gullet structures for rider weight induced clamping of the inventive assembly's flexible "T" hook.

Other and further objects, benefits, and advantages of the instant invention have been described above, and will become further known to those skilled in the art upon review of the Detailed Description which follows, and upon review of the appended drawings.

DETAILED DESCRIPTION OF A PREFERRED EMBODIMENT

Figure 1:
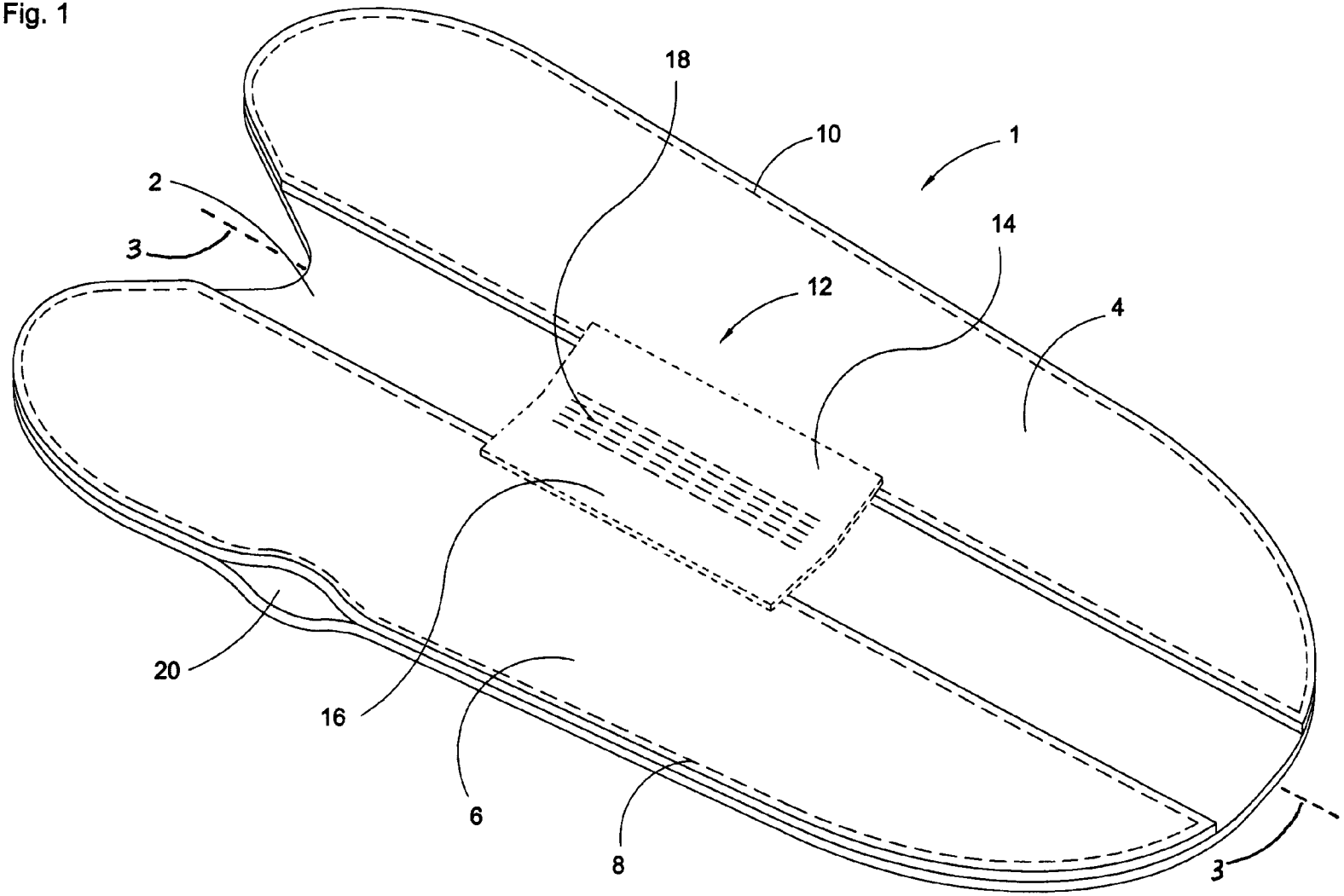
FIG. 1 is an isometric view of a preferred embodiment of the instant inventive saddle cushioning assembly.

Referring now to the drawings, and in particular to FIG. 1, a preferred embodiment of the instant inventive saddle cushioning assembly is referred to generally by Reference Arrow 1. The assembly 1 preferably comprises a flexible pad 2, the flexible pad 2 preferably being composed of lamb skin having soft downwardly extending wool loft.

Figure 4:
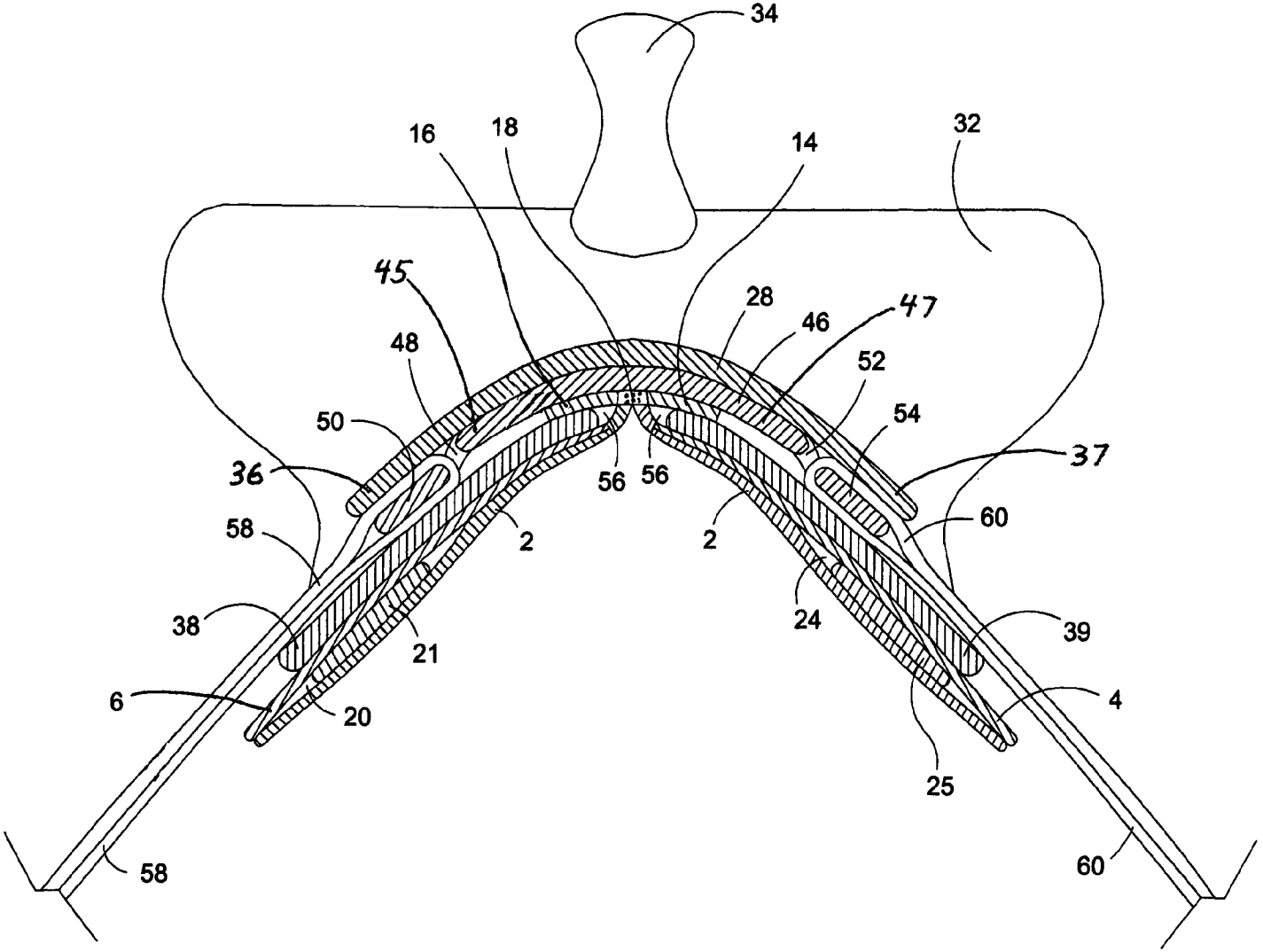
FIG. 4 is a sectional view as indicated in FIG. 3.

Referring further to FIG. 1, the flexible pad 2 preferably is bilaterally symmetrical having a longitudinal midline indicated by dashed reference line 3. The pad 2 preferably has right and left longitudinally extending shim receiving pockets 4 and 6, pocket 6 being attached to pad 2 by stitching 8, and pocket 4 being attached to pad 2 by stitching 10. The left side of the pad 2 in combination with the pocket 6 advantageously defines a left shim receiving pocket space 20 and, referring further simultaneously to FIG. 2, the combination of the right side of the pad 2 and pocket 4 similarly defines a right shim receiving pocket space 24. Referring further simultaneously to FIG. 4, left and right shims 21 and 25, each preferably comprising a dense felt pad, are preferably custom fitted and sized and are received and positioned within the spaces 20 and 24 defined by pockets 6 and 4.

Figure 2:
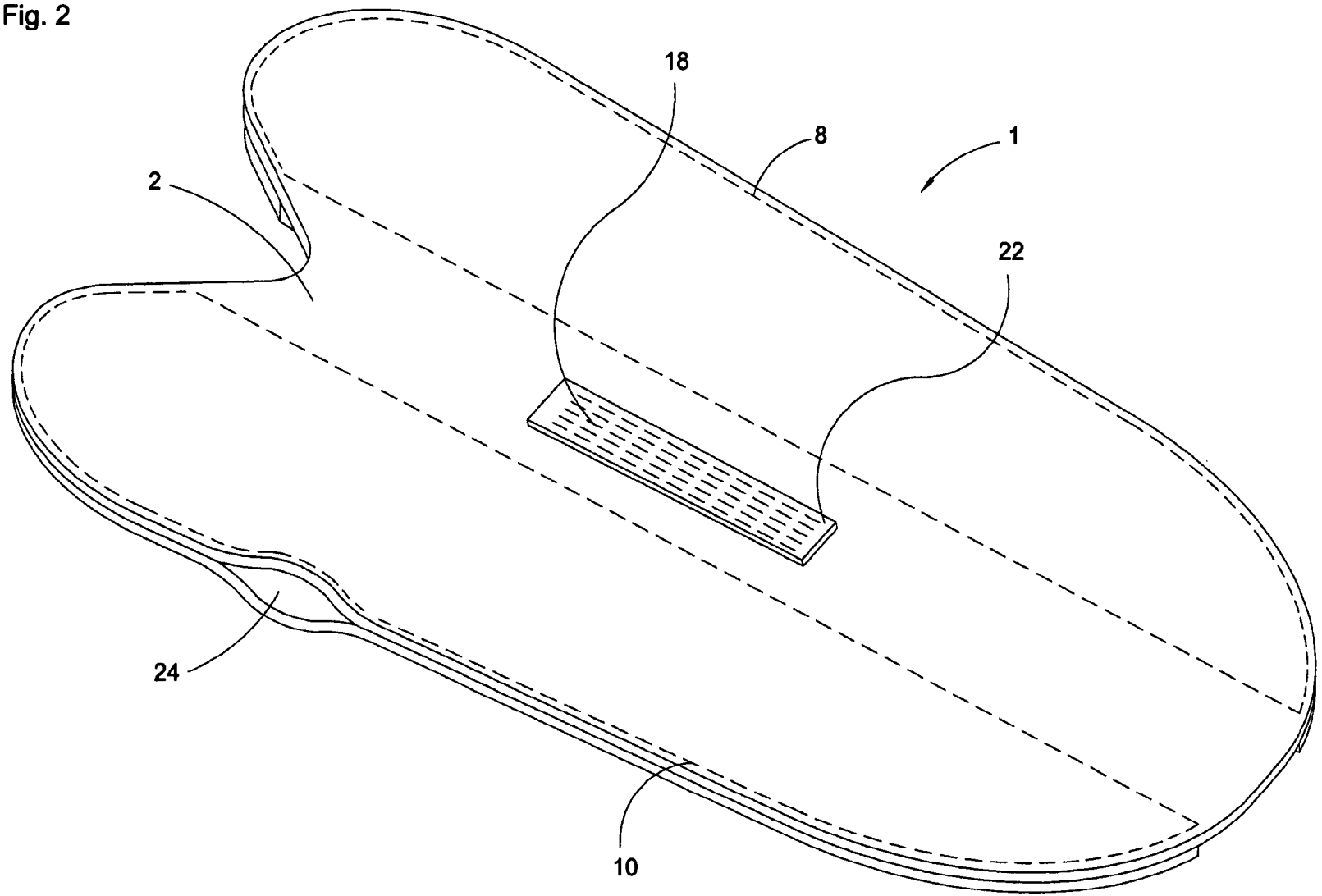
FIG. 2 is an inverted view of the assembly depicted in FIG. 1.

Referring further to FIG. 1, the dashed line structure identified by Reference Arrow 12 representationally signifies a flexible "T" hook or tab element. Preferably, the "T" hook element 12 comprises a flexible plastic sheet or panel fixedly attached to the pad 2 by stitching 18, such plastic sheet presenting a leftwardly cantilevering arm 16 and a rightwardly cantilevering arm 14. Referring further simultaneously to FIG. 2, the stitching 18 preferably passes through the "T" hook 12 and thence through the pad 2 to extend through and to be securely received by a woven nylon strap 22. In such configuration, the stitching 18 compressively "sandwiches" the pad 2 between the "T" hook 12 and the strap 22 for securely and fixedly attaching the "T" hook 12 to the pad 2.

Figure 3:
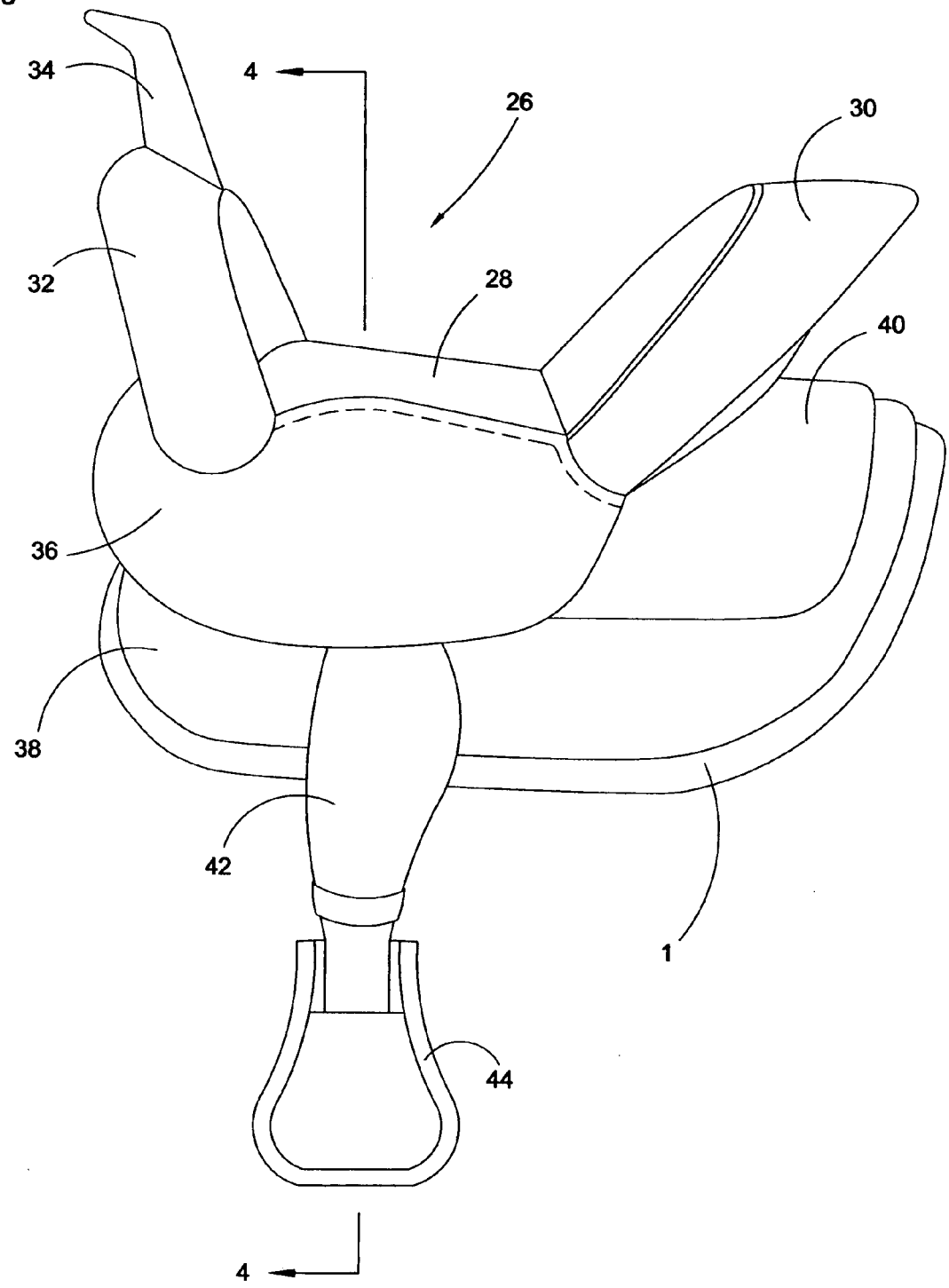
FIG. 3 depicts an exemplary saddle including the inventive assembly.

Referring simultaneously to FIGS. 1, 3, and 4, the combination of the flexible pad 2 and the "T" hook 12 may be advantageously installed in relation to an exemplary western saddle which is referred to generally by reference arrow 26. Such saddle 26 typically includes a seat 28, 46, a forward swell or pommel 32, a saddle horn 34, a rearward cantle 30, a left side jockey 36, a right side jockey 37, a left skirt panel 38, a right skirt panel 39, a left stirrup strap 58, a right stirrup strap 60, left and right stirrups 44 suspending from the lower ends of stirrup straps 58 and 60, and left and right stirrup fenders 42 overlying and protecting the left and right stirrup straps 58 and 60.

Referring simultaneously to FIGS. 3 and 4, the internal support frame of the saddle 26 comprises a unitary injection molded polyethylene saddle tree 50, 45, 46, 47, and 54 commonly known as a "Ralide" tree. The unitary saddle tree has longitudinally extending left and right sides 45 and 47, such left and right sides 45 and 47 comprising or substituting for the left and right bars which are commonly present in traditional wooden open gullet saddle trees. The extreme lateral left and right edges 50 and 54 of the saddle tree 46 are preferably formed to present stirrup loop receiving slots or apertures 48 and 52 from which stirrup straps 58 and 60 suspend.

Referring further simultaneously to FIGS. 3 and 4, the upper inner ends of the left and right skirt panels 38 and 39 form and define a longitudinally extending midline gullet space 56. In assembling the instant invention for use, referring simultaneously to all figures, the distal end of arm 14 of the "T" hook may be extended upwardly and rightwardly into the midline gullet space 56. Upon such insertion, such distal end may be immediately further slidably extended between the upper inner end of the right skirt panel 39 and the lower surface of the seat 28, 46. Thereafter, the "T" hook 12 may be further flexibly manipulated to oppositely extend the distal end of the left arm 16 of the "T" hook 12 between the upper inner end of the left skirt panel 38 and the lower surface of the seat 28, 46. Thereafter, the left and right sides of the flexible pad 2 may be leftwardly and rightwardly splayed to respectively underlie and cushion the left and right skirt panels 38 and 39. Ideally, the shim pads 21 and 25 are preliminarily custom fitted positioned, and situated within their pocket spaces 20 and 24 to accurately match the physical contours of the back of a horse to be saddled.

Referring further simultaneously to all figures, a horse saddled with saddle 26 may be mounted by a rider (not depicted) seated upon seat 28, 46. The weight of such rider advantageously causes the seat 28, 46 in combination with the upper inner ends of the skirt panels 38 and 39 to respectively function as upper and lower jaws of left and right clamps. Such left and right clamps respectively receive and via the rider's weight, securely hold the left and right "T" hook arms 16 and 14 in their proper midline orientation with respect to the saddle's midline gullet space 56. The left and right clamps advantageously serve to secure the saddle pad 1 in its proper fitted orientation with respect to both the horse and the saddle 26.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A saddle cushioning assembly for cushioning a saddle having a gullet, the saddle cushioning comprising:

(a) a flexible pad having an upper surface and having a longitudinal midline;

(b) a flexible "T" hook having left and right arms, the flexible "T" hook being fitted for receipt within the gullet; and (c) hook attaching means fixedly interconnecting the flexible pad and the flexible "T" hook, the hook attaching means positioning the flexible "T" hook so that the flexible "T" hook's left and right arms overlie the flexible pad's upper surface and so that said arms respectively extend leftwardly and rightwardly from the flexible pad's longitudinal midline.

2. The saddle cushioning assembly of claim 1 wherein the flexible "T" hook comprises a plastic panel.

3. The saddle cushioning assembly of claim 2 wherein the plastic panel has asperous upper and lower surfaces.

4. The saddle cushioning assembly of claim 3 wherein the plastic panel is perforate.

5. The saddle cushioning assembly of claim 2 wherein the plastic panel comprises a sheet of square grid plastic canvas.

6. The saddle cushioning assembly of claim 2 wherein the hook attaching means comprises stitching.

7. The saddle cushioning assembly of claim 6 wherein the hook attaching means further comprises a backing strap underlying the flexible pad, the backing strap receiving the stitching.

8. The saddle cushioning assembly of claim 1 wherein the flexible pad comprises at least a first shim pocket, and further comprising at least a first shim, the at least first shim being received within the at least first shim pocket.

9. A saddle cushioning assembly comprising:

(a) left and right "T" hook clamps, each "T" hook clamp among the left and right "T" hook clamps having an upper and a lower jaw, the left and right "T" hook clamps' upper jaws respectively comprising a saddle seat undersurface, the left and right "T" hook clamps' lower jaws respectively comprising left and right saddle skirt panels;

(b) a flexible "T" hook having left and right arms, the left and right "T" hook clamps respectively receiving the flexible "T" hook's left and right arms;

(c) a flexible pad having a longitudinal midline, having a left side extending leftwardly from the longitudinal midline, and having a right side extending rightwardly from the longitudinal midline; and (d) attaching means fixedly interconnecting the flexible "T" hook and the flexible pad, the attaching means positioning the flexible pad so that the flexible pad's left and right sides may respectively underlie the left and right saddle skirt panels.

10. The saddle cushioning assembly of claim 9 wherein the flexible "T" hook comprises a plastic panel.

11. The saddle cushioning assembly of claim 10 wherein the plastic panel has asperous upper and lower surfaces.

12. The saddle cushioning assembly of claim 11 wherein the plastic panel is perforate.

13. The saddle cushioning assembly of claim 10 wherein the plastic panel comprises a sheet of square grid plastic canvas.

14. The saddle cushioning assembly of claim 10 wherein the attaching means comprises stitching.

15. The saddle cushioning assembly of claim 14 wherein the attaching means further comprises a backing strap underlying the flexible pad, the backing strap receiving the stitching.

16. The saddle cushioning assembly of claim 9 wherein the flexible pad comprises at least a first shim pocket, and further comprising at least a first shim, the at least first shim pocket receiving the at least first shim.

* * * * *